US006017252A

United States Patent [19]

May et al.

[11] Patent Number: 6,017,252

[45] Date of Patent: Jan. 25, 2000

[54] PLUG CONNECTOR HAVING A HOUSING WITH A SECONDARY INTERLOCK

[75] Inventors: Guntram May, Altdorf; Steffen Muller, Nurenberg, both of Germany

[73] Assignee: Framatome Connectors International, Courbevoie, France

[21] Appl. No.: 09/158,203

[22] Filed: Sep. 22, 1998

[30] Foreign Application Priority Data

Sep. 23, 1997 [DE] Germany ..... 197 41 949

[51] Int. Cl.[7] ..... H01R 13/514

[52] U.S. Cl. ..... 439/752; 439/752; 439/595; 439/598; 439/599

[58] Field of Search ..... 439/752, 598, 439/599, 595

[56] References Cited

U.S. PATENT DOCUMENTS

| | | | |
|---|---|---|---|
| 4,319,799 | 3/1982 | Pearce, Jr. | 339/217 R |
| 4,721,478 | 1/1988 | Sonobe | 439/278 |
| 5,403,211 | 4/1995 | Sayer et al. | 439/752 |
| 5,516,309 | 5/1996 | Sayer et al. | 439/752 |
| 5,554,055 | 9/1996 | Miller | 439/652 |
| 5,556,304 | 9/1996 | Jinno | 439/595 |
| 5,575,685 | 11/1996 | Ittah et al. | 439/595 |
| 5,595,509 | 1/1997 | Fry et al. | 439/595 |
| 5,725,398 | 3/1998 | Cappe | 439/752 |

FOREIGN PATENT DOCUMENTS 8905583 8/1989 Germany .

*Primary Examiner*—Paula Bradley
*Assistant Examiner*—Truc Nguyen
*Attorney, Agent, or Firm*—Perman & Green, LLP

[57] ABSTRACT

The present invention relates to a plug connector (1) having a housing (2, 3) with a secondary interlock (4), the housing (2, 3) having at least one longitudinal channel (5) for holding a contact, and the secondary interlock (4) being arranged on the housing (2, 3) such that it can be displaced transversely with respect to the channel axis in order to fix contacts in its channels. The housing is composed of two parts (2, 3) which are attached to one another in the region of the secondary interlock (4) and leave a space free between them in which the secondary interlock (4) can be displaced and can be inserted from above during assembly.

11 Claims, 2 Drawing Sheets

PLUG CONNECTOR HAVING A HOUSING WITH A SECONDARY INTERLOCK

BACKGROUND OF THE INVENTION

The present invention relates to a plug connector having a housing with a secondary interlock according to the precharacterizing clause of Patent claim 1. Such plug connectors are always used wherever it is necessary reliably to prevent subsequent removal of the contact pins from the channels.

As a rule, a secondary interlock is composed of a slide which is displaced transversely with respect to the longitudinal axis of the plug contact channels and which is formed such that, in an interlocked position, it engages behind shoulders constructed on the plug contacts and, in a fitting position, completely releases the channels.

The compact structure and external geometry of such plug connector housings does not always allow the arrangement of such secondary interlocks since components of the housing itself make it impossible to fit or operate a secondary interlock.

SUMMARY OF THE INVENTION

The present invention is based on the object of improving a plug connector of the generic type such that a secondary interlock, having a slide which can be moved transversely with respect to the longitudinal extent of the contact holders, can be provided on the slide housing even if the space conditions are constricted.

This object is achieved according to the claim. The dependent claims characterize preferred embodiments of the plug connector according to the invention.

BRIEF DESCRIPTION OF THE DRAWINGS

The invention will be explained in more detail using the description of an exemplary embodiment and with reference to the drawing, in which.

DETAILED DESCRIPTION OF THE PREFERRED EMBODIMENT

Figure 1:
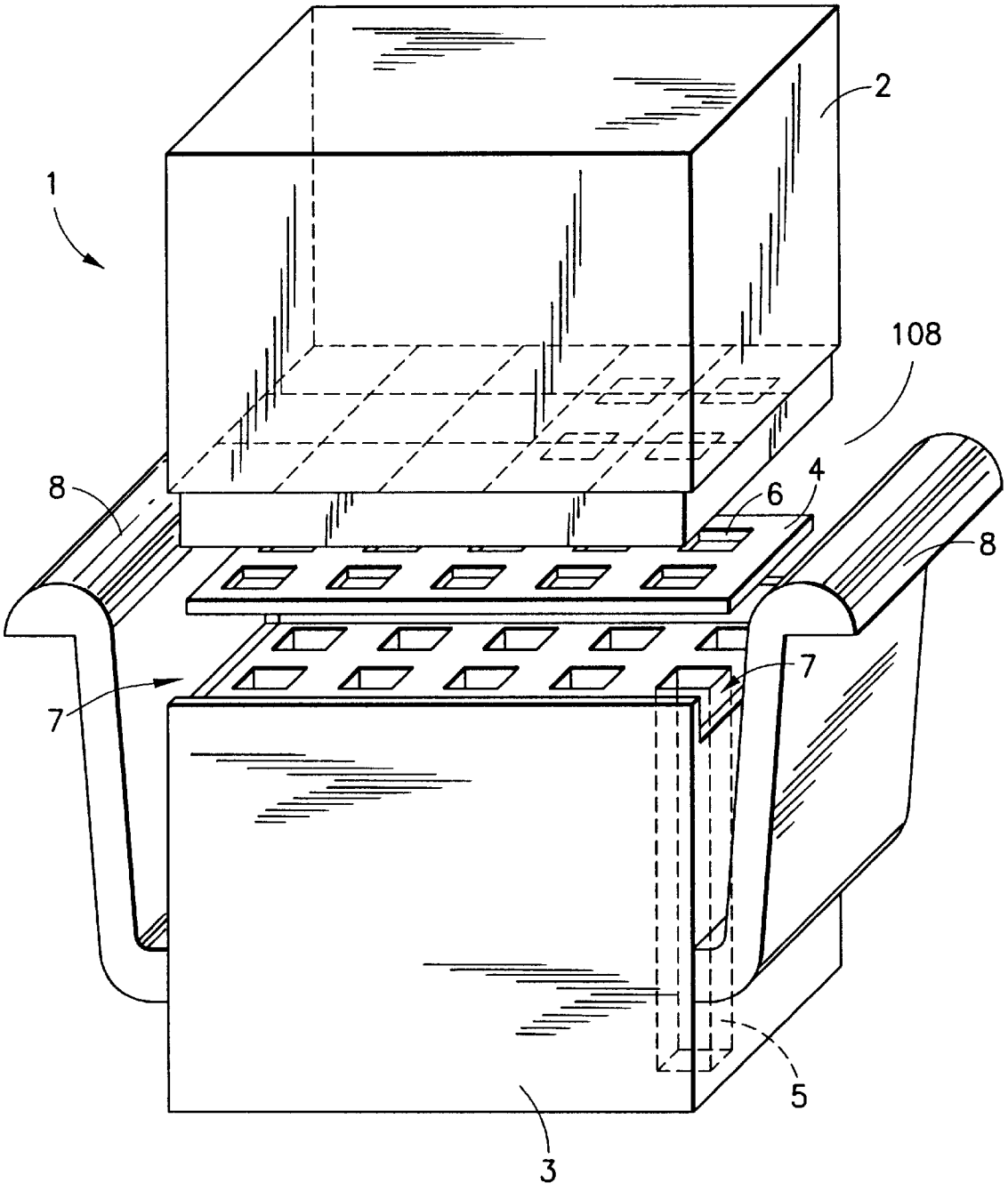
FIG. 1 shows a plug connector according to the invention in the disconnected state.

FIG. 1 shows the plug connector 1 with two housing parts 2 and 3 which can be plugged together approximately in their horizontal centre plane. The two plug connector halves have aligning longitudinal channels 5 for holding the contact connectors, the secondary interlock comprising a slide 4 which can be displaced in a chamber 108 (see FIG. 2) formed between the two plug connector housing halves 2, 3 which can be plugged to one another. Spring arms 8, by means of which the plug connector can be latched in its envisaged environment, are fitted on the lower housing half 3, in the right-hand and left-hand side walls. These spring arms 8 are located in front of the end of the intermediate space between the two housing halves in which the slide 4 is arranged such that it can move.

This geometry makes it necessary for it to be possible to insert the slide 4 from above into the chamber or shaft provided for it, since insertion at the side is not possible.

In the mated state with the inserted slide 4, sufficient space or openings 7 remains, however, to the right and left sides of the housing alongside the spring arms to allow, if necessary, the slide 4 to be moved (using a tool) from the fitting position, in which the contact openings 6 in the slide 4 are substantially aligned with the contact holding channels 5 in the housing thereby substantially completely releasing the contacts in the holding channels 5, into an interlocking position in which it secures the contact plugs against unintentionally being pulled out of the holding channels. When the slide 4 is in the interlocking position, the contact openings 6 in the slide 4 fix the contacts to the housing 2, 3 with an edge of the openings 6.

Figure 2:
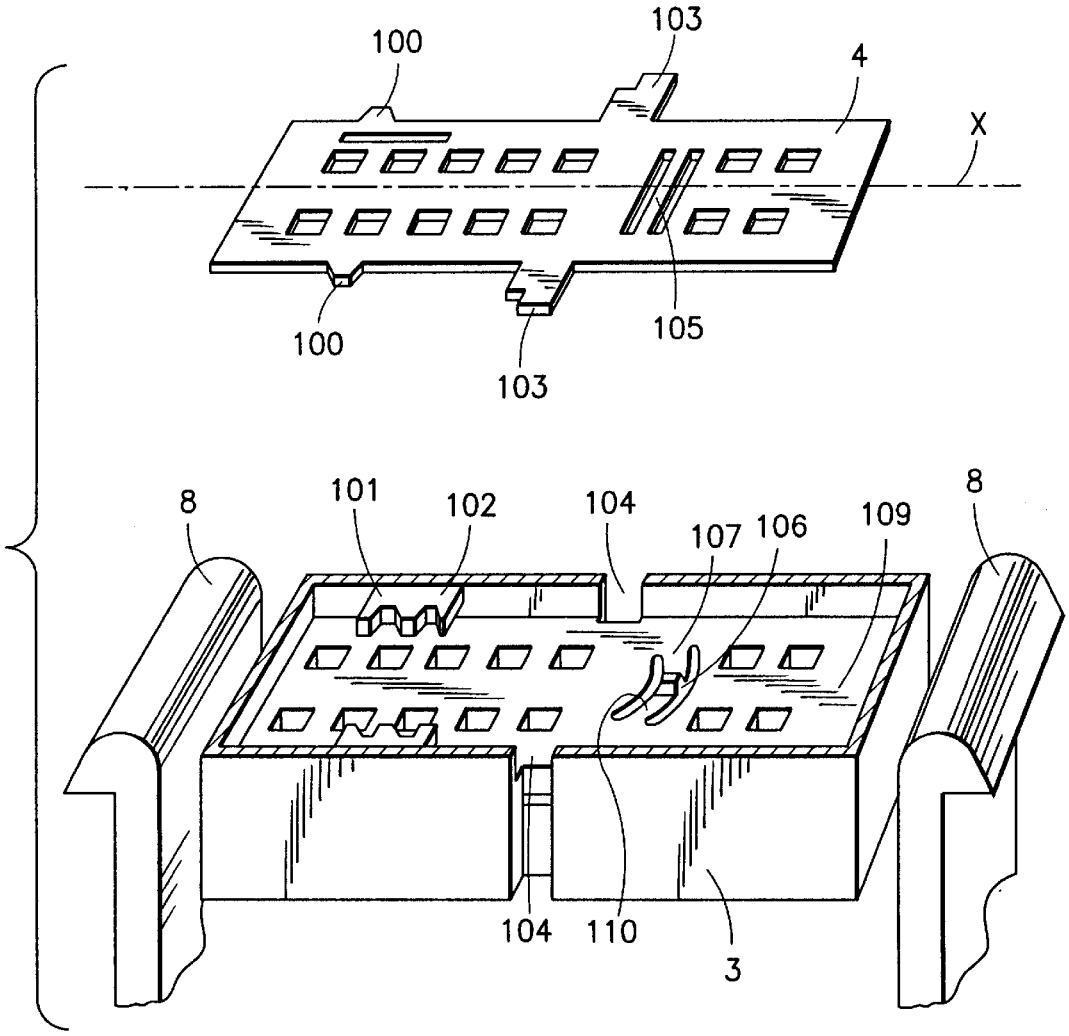
FIG. 2 shows details of the lower housing part and of the slide, in a perspective view.

FIG. 2 shows the slide 4 and the part of the lower housing half 3 that holds it. On its side edges, the slide has elastic projecting shoulders 100 which engage in corresponding interlocking catches 101, 102 on the lower housing part 3, in such a manner that the slide latches in both in a first, contact plug insertion position and in a second, contact interlocking position, and can be displaced between these positions. Furthermore, FIG. 2 shows coding ribs 103 on the two longitudinal edges of the slide 4, which coding ribs engage in corresponding coding grooves 104 in the lower housing part 3. When engaged in the coding grooves, the coding ribs 103, which are elastic and projecting at substantially right angles to the slide longitudinal axis X, produce a spring stress when the slide is moved between the two latched positions. A web or a 105 is formed in the slide 4 by two continuous grooves being arranged closely alongside one another, transversely with respect to the longitudinal extent of the slide. The web 105 is centrally disposed on the slide 4 so that the longitudinal axis X of the slide 4 extends through the web 105. The longitudinal axis X of the slide 4 is substantially aligned to the direction of movement of the slide 4 relative to the housing 3. This web 105 has a certain amount of elasticity which is used to make it possible to jump over a tooth 106 which is positioned in its way and is arranged on the base or bottom face 109 of the shaft likewise resulting in the slide 4 latching in two positions, namely a position in which the tooth 106 in FIG. 2 latches to the right of the web 105, and a position in which the tooth latches to the left of the web 105. This latching can be used as an alternative to or as a complement to the latching produced by the elements 100, 101 and 102.

The exemplary embodiment described above has been described only for illustrative purposes and should not be regarded as being limiting in any way.

What is claimed is:

1. In a plug connector comprising a housing having at least one longitudinal channel for holding a contact therein, the housing further including a first housing part and a second housing part matingly connected to each other and forming a chamber in the housing, wherein the plug connector further comprises a slide for locking the contact to the housing, the slide being disposed in the chamber substantially transversely with respect to the longitudinal channel, the chamber being sized to allow the slide to slide relative to the housing from a first position to a second position, wherein the improvement comprises:

the housing having an elastic holding element projecting from a face of the chamber and engaging an inner central section of the slide proximate a longitudinal axis of the slide to lock the slide relative to the housing in the first position.

2. A plug connector according to claim 1, wherein the slide disposed in the chamber forms openings on opposite sides of the housing which allow the slide to slide in the chamber between the first and second position, and wherein the housing has spring arms mounted alongside the opposite sides of the housing.

3. A plug connector according to claim 2, wherein the slide has an elastic projection projecting from the slide at substantially right angles to the longitudinal axis of the slide, and wherein the elastic projection on the slide engages an aperture in the first housing part to produce a spring stress between the first and second positions.

4. A plug connector according to claim 2, wherein the slide has projecting shoulders which engage interlock catches in the first housing part to lock the slide relative to the housing in both the first and the second positions.

5. A plug connector according to claim 2, wherein the slide has at least one coding rib, and wherein the first housing part has a coding groove formed therein, the coding rib engaging the coding groove in the first housing part when the slide in the first position.

6. A plug connector comprising:

a housing having at least one longitudinal channel for holding a contact therein, the housing further including a first housing part and a second housing part matingly connected to each other and forming a chamber in the housing; and a slide for locking the contact in the longitudinal channel to the housing, the slide being disposed in the chamber substantially transversely with respect to the longitudinal channel, the chamber being sized to allow the slide to slide in the chamber relative to the housing from a first position to a second position, the slide having a pair of grooves formed therein to form a centrally disposed elastic web within the slide;

wherein the housing has an elastic holding element engaging the web in the slide to lock the slide in a position, the elastic holding element comprising a curved elastic bridge formed in a face of the chamber defined by the first housing, the curved elastic bridge having a tooth member disposed thereon, the tooth member engaging a first side of the web to lock the slide in the first position, and the tooth engaging a second side of the web to lock the slide in the second position.

7. A plug connector according to claim 6, wherein when the slide is moved from the first position to the second position, the web rides over the tooth.

8. A plug connector according to claim 6, wherein the slide disposed in the chamber forms openings on opposite sides of the housing which allow the slide to slide in the chamber between the first and second position, and wherein the housing has spring arms mounted alongside the opposite sides of the housing.

9. A plug connector according to claim 6, wherein the slide has an elastic projection projecting from the slide at substantially right angles to the longitudinal axis of the slide, and wherein the elastic projection on the slide engages an aperture in the first housing part to produce a spring stress between the first and second positions.

10. A plug connector according to claim 6, wherein the slide has projecting shoulders which engage interlock catches in the first housing part to lock the slide relative to the housing in both the first and the second positions.

11. A plug connector according to claim 6, wherein the slide has at least one coding rib, and wherein the first housing part has a coding groove formed therein, the coding rib engaging the coding groove in the first housing part when the slide in the first position.

* * * * *